US008919927B2

(12) United States Patent
Ono

(10) Patent No.: US 8,919,927 B2
(45) Date of Patent: Dec. 30, 2014

(54) LIQUID EJECTION HEAD AND METHOD OF MANUFACTURING THE SAME

(71) Applicant: Canon Kabushiki Kaisha, Tokyo (JP)

(72) Inventor: Takayuki Ono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/937,393

(22) Filed: Jul. 9, 2013

(65) Prior Publication Data

US 2014/0029229 A1 Jan. 30, 2014

(30) Foreign Application Priority Data

Jul. 24, 2012 (JP) ..... 2012-163589

(51) Int. Cl.
*B41J 2/14* (2006.01)
*B41J 2/16* (2006.01)

(52) U.S. Cl.
CPC *B41J 2/1623* (2013.01); *B41J 2/16* (2013.01); *B41J 2/1603* (2013.01); *B41J 2/14072* (2013.01); *B41J 2/14* (2013.01); *B41J 2/14032* (2013.01)
USPC ..... 347/50; 347/58; 347/12; 347/40

(58) Field of Classification Search
CPC .. B41J 2/14024; B41J 2/1623; B41J 2/14072; B41J 2/17526; B41J 2/1753
USPC ..... 347/12, 13, 20, 40, 42, 50, 56–58, 63
See application file for complete search history.

(56) References Cited

U.S. PATENT DOCUMENTS

| | | | | |
|---|---|---|---|---|
| 6,869,168 | B2 * | 3/2005 | Terui | 347/50 |
| 7,118,199 | B2 * | 10/2006 | Mori | 347/58 |
| 7,732,228 | B2 | 6/2010 | Ono et al. | |
| 8,007,076 | B2 | 8/2011 | Ono | |
| 8,210,647 | B2 | 7/2012 | Shimazu et al. | |

FOREIGN PATENT DOCUMENTS

| | | |
|---|---|---|
| JP | 2005-41158 A | 2/2005 |

* cited by examiner

*Primary Examiner* — Juanita D Jackson
(74) *Attorney, Agent, or Firm* — Fitzpatrick, Cella, Harper & Scinto

(57) ABSTRACT

A liquid ejection head includes two or more substrates disposed side by side, each having energy generating elements and primary terminals electrically connected to the respective energy generating elements, and an electrical wiring member having primary flying leads electrically connected to the respective primary terminals by means of gang bonding. Each of the substrates has an auxiliary terminal located adjacent to the primary terminals and the auxiliary terminals of the two or more substrates are disposed adjacent to each other. The electrical wiring member has an auxiliary flying lead connected to the auxiliary terminals of the substrates by means of a gang bonding system.

10 Claims, 6 Drawing Sheets

LIQUID EJECTION HEAD AND METHOD OF MANUFACTURING THE SAME

BACKGROUND OF THE INVENTION

1. Field of the Invention

The present invention relates to a liquid ejection head and a method of manufacturing the same. More particularly, the present invention relates to arrangements of flying leads.

2. Description of the Related Art

Known typical electric connection systems for connecting one or more than one substrates having energy generating elements and an electric wiring member having flying leads include single point bonding systems and gang bonding systems.

With single-point bonding systems, a bonding operation is conducted individually on each flying lead, while checking the bonding position for the flying lead. Such bonding systems require preparatory operations including forming stud bumps and leveling before ultimately executing the bonding operations and the apparatus to be used for such bonding operations represents a complex configuration. The processing tact for such an apparatus depends on the number of flying leads. Since ultimate bonding operations are conducted by using ultrasonic waves, the bonding strength tends to be low.

With gang bonding systems, on the other hand, the connection pads on one or more than one substrates having energy generating elements are plated with gold or a gold-tin alloy and all the flying leads are crimped to the respective connection pads by applying heat and pressure so as to collectively bond them to the connection pads. Thus, the stress generated in the connection pads is suppressed to a low level and a high bonding strength can be achieved. Since all the flying leads are collectively bonded by means of a broad bonding tool, the flying leads can be correctly positioned with ease in a transversal direction (in the direction in which they are aligned). As a result, the apparatus to be used for gang bonding represents a relatively simple configuration. Since the time required for the bonding operation is substantially constant regardless of the number of flying leads, the processing tact for such an apparatus does not depend on the number of flying leads and hence the processing tact, the conditions on the processing steps and other factors can be selected and set with a high degree of freedom. Japanese Patent Application Laid-Open No. 2005-41158 describes a gang bonding system.

FIG. 10A of the accompanying drawings schematically illustrates flying leads that are electrically connected to so many connection pads of a substrate by means of a gag bonding system. A plurality of connection pads 3 are arranged on a substrate 1 having energy generating elements and the flying leads 2 of an electrical wiring member as many as the connection pads 3 are collectively aligned with the respective connection pads 3. Subsequently, the flying leads 2 are collectively bonded to the respective connection pads 3 by means of a bonding tool 6 having a width greater than the total width of the flying leads 2 (see FIG. 10C). As a result, the flying leads 2 represent traces 19 of thermal crimping.

Generally, a plurality of substrates is juxtaposed as illustrated in FIG. 10B and the individual substrates 1*a*, 1*b* are bonded in advance to an ink-supply and holding member (or an ink-supply assisting member) H1500 by means of an adhesive agent 10 or the like as illustrated in FIG. 10C. However, the top surfaces of the substrates 1*a*, 1*b* can hardly be made flush with each other for a number of reasons such as variance of the thickness of the adhesive agent 10 and inclination of the top surface of the ink-supply and holding member H1500.

Then, a gang bonding operation can be executed only with difficulty in a state as illustrated in FIG. 10C. For this reason, the use of a dedicated bonding apparatus may be conceivable for gang bonding. More specifically, a plurality of substrates is aligned by means of a dedicated gang bonding apparatus and then a gang bonding operation is executed. Thereafter, the plurality of substrates is collectively bonded to an ink-supply and holding member along with an electrical wiring member. In this operation, the plurality of substrates and the electrical wiring member are received from the gang bonding apparatus by means of a dedicated finger and delivered to the ink-supply and holding member.

However, when using a dedicated gang bonding apparatus as described above, the substrates can move relative to each other so as to be displaced from each other in directions out of the plane that is supposed to be defined by the top surfaces of the substrates. Then, the plurality of substrates cannot be found on a single plane as a whole. Thus, the plurality of substrates cannot be placed in position so as to be held in parallel with the top surface (bonding surface) of the ink-supply and holding member to make the operation of bonding the substrates to the ink-supply and holding member a difficult one.

SUMMARY OF THE INVENTION

In view of the above-identified problem, therefore, the object of the present invention is to provide a liquid ejection head having a plurality of substrates that can hardly move relative to each other after the plurality of substrates and an electrical wiring member are electrically connected by means of gang bonding and a method of manufacturing such a liquid ejection head.

In an aspect of the present invention, there is provided a liquid ejection head including: a first substrate and a second substrate disposed side by side, each having energy generating elements and primary terminals electrically connected to the respective energy generating elements; and an electrical wiring member having primary flying leads electrically connected to the respective primary terminals by means of a gang bonding system, the electrical wiring member being arranged adjacent to the first and second substrates; each of the first and second substrates having an auxiliary terminal located adjacent to the respective primary terminals, the auxiliary terminals of the substrates being disposed adjacent to each other, the electrical wiring member having an auxiliary flying lead connected to or a pair of auxiliary flying leads respectively connected to the auxiliary terminals of the first and second substrates by means of a gang bonding system.

In another aspect of the present invention, there is provided a method of manufacturing a liquid ejection head including: bringing in a first substrate and a second substrate, each having energy generating elements, primary terminals electrically connected to the respective energy generating elements and one or more than one auxiliary terminals disposed adjacent to the respective primary terminals; arranging the first and second substrates so as to be located side by side such that the auxiliary terminal of one of the substrates is disposed adjacent to that of the other substrate; arranging an electrical wiring member having at least two primary flying leads and an auxiliary flying lead adjacent to the first and second substrates and electrically connecting the primary terminals to the respective primary flying leads and also the auxiliary terminals of the first and second substrates to the auxiliary flying lead by means of a gang bonding system.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The present invention relates to a liquid ejection head that includes two or more substrates, each having energy generating elements, and an electrical wiring member having flying leads electrically connected to the substrates by gang bonding and also to a method of manufacturing such a liquid ejection head. Before describing embodiments of the present invention, a liquid ejection head according to the present invention will be summarily described below. The description commonly applies to the embodiments.

A liquid ejection head according to the present invention includes energy generating elements (electrothermal transducers or electrothermal conversion elements) that generate thermal energy for causing ink to give rise to film boiling according to the electric signal applied to them. Such a head is also referred to as a Bubblejet (trade-name) head. The energy generating elements are arranged vis-à-vis the respective ink ejection ports of the head (the so-called side shooter type).

(1) Liquid Ejection Head H1000

Figure 6:
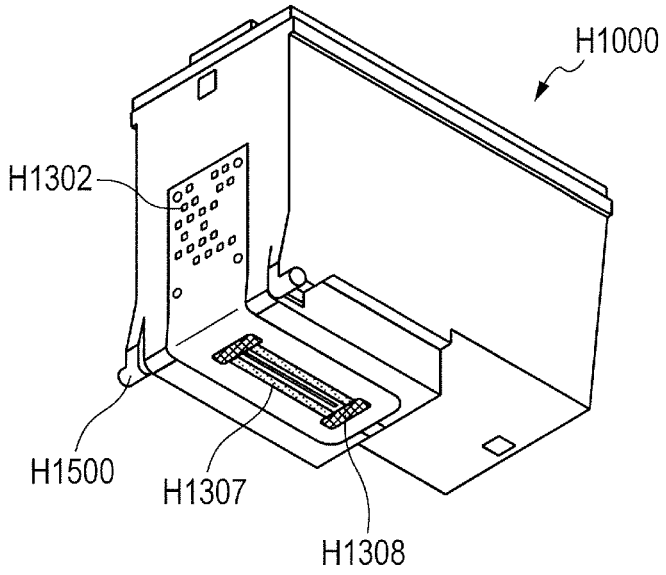
FIG. 6 is a perspective view of a liquid ejection head according to the present invention.
Figure 7:
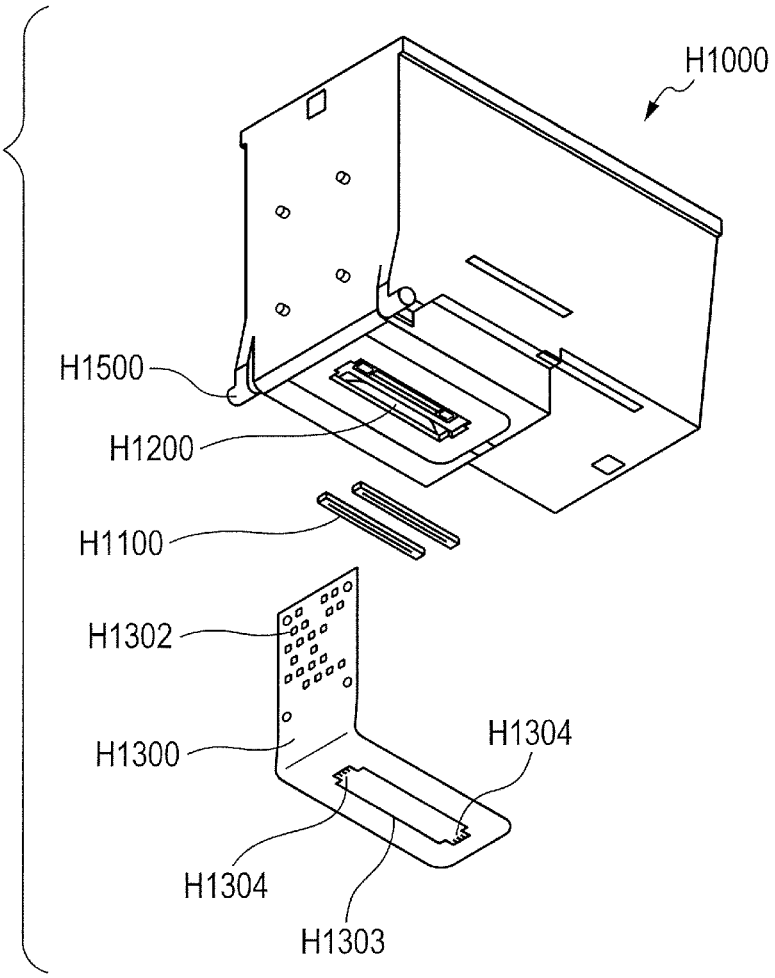
FIG. 7 is an exploded perspective view of the liquid ejection head illustrated in FIG. 6.

FIGS. 6 and 7 are a schematic perspective view and an exploded perspective view of liquid ejection head H1000. The liquid ejection head H1000 includes substrates H1100, each having energy generating elements H1103 (see FIG. 8), an electrical wiring member H1300 having flying leads H1304 and an ink-supply and holding member H1500.

(1-1) Substrate H1100 Having Energy Generating Elements

Figure 8:
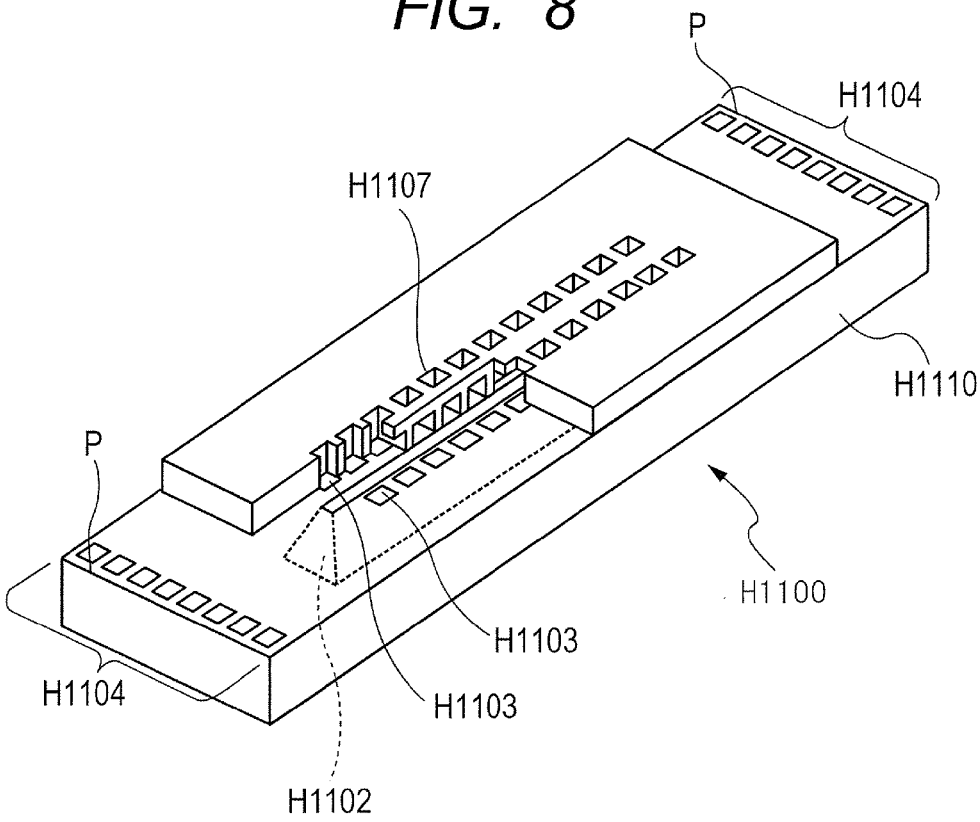
FIG. 8 is a schematic illustration of one of the substrates of the liquid ejection head illustrated in FIG. 6.

FIG. 8 is a partly cut away perspective view of substrate H1100 having energy generating elements H1103, schematically illustrating the configuration of the substrate. The substrate H1100 is made of silicon (Si) and prepared by forming an ink channel H1102 in a 0.5 mm to 1 mm thick Si substrate H1110. The ink channel H1102 is formed as a through aperture, or a long groove, that can be produced by means of an anisotropic etching system utilizing the crystal orientation of Si or by sandblasting.

A row of energy generating elements H1103 is formed along each side of the ink channel H1102 of the substrate H1110. Thus, the ink channel H1102 is sandwiched by two rows of energy generating elements H1103. Electrical wirings (not illustrated) that are typically made of aluminum (Al) are additionally formed on the substrate H1110 to supply electricity to the energy generating elements H1103. Both the energy generating elements H1103 and the electrical wirings can be formed by utilizing a known film forming technique. The energy generating elements of the two rows are arranged in a zigzag manner. In other words, the energy generating elements of the two rows are displaced from each other such that any two of them of the two rows are not aligned in a direction orthogonal to the running direction of the rows. The ink supplied from the ink channel H1102 is ejected from the ejection ports H1107 arranged vis-à-vis the respective energy generating elements H1103 as pressure is applied to the ink by air bubbles that are produced as the energy generating elements H1103 generate heat. A plurality of electrically connecting sections H1104, which may be so many bumps or pads, is formed along the two short sides of the substrate H1110. The electrically connecting sections H1104 are connected to the energy generating elements H1103 by way of the above-described electrical wirings.

(1-2) Electrical Wiring Member H1300 Having Flying Leads

Figure 9:
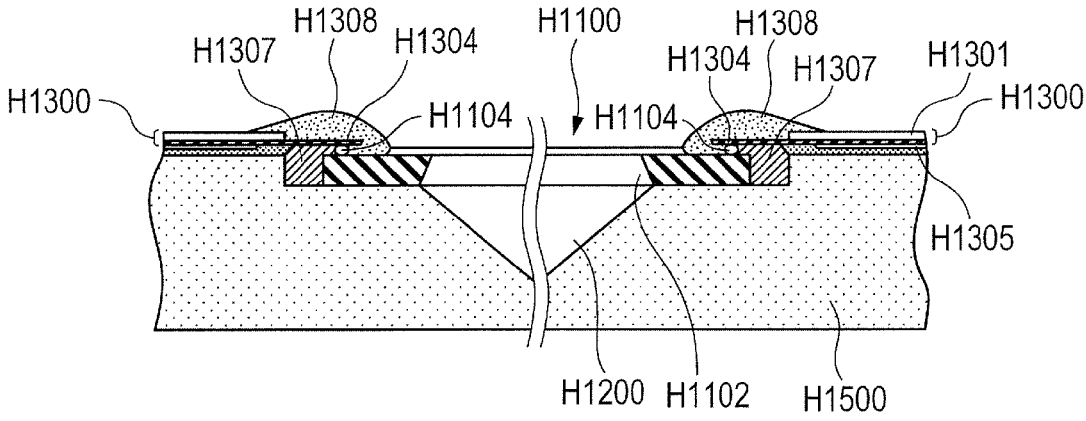
FIG. 9 is a schematic cross-sectional view of the electrically connecting sections of the liquid ejection head illustrated in FIG. 6.
Figure 10A:
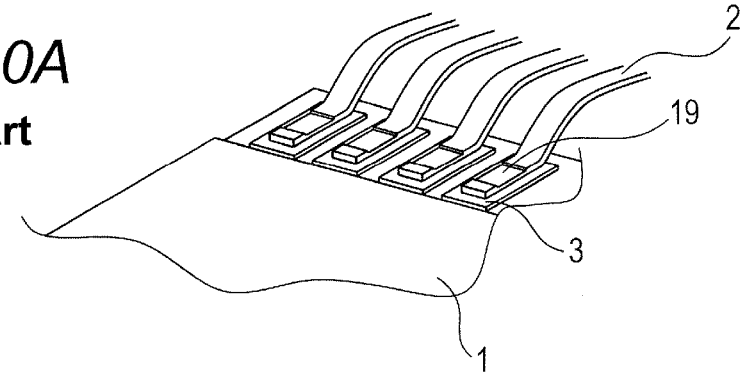
FIG. 10A Prior Art
FIGS. 10A, 10B and 10C are a schematic illustration of an electrically connecting section formed by means of a known gang bonding system.
Figure 10B:
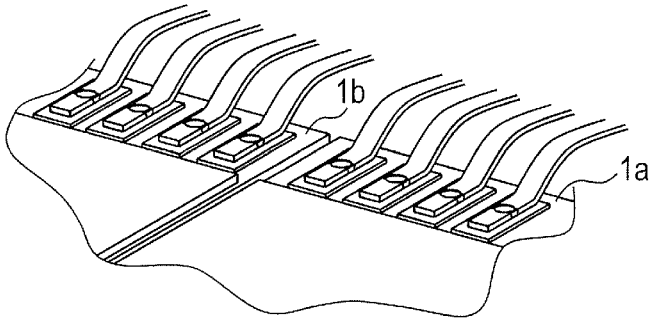
FIG. 10B Prior Art
Figure 10C:
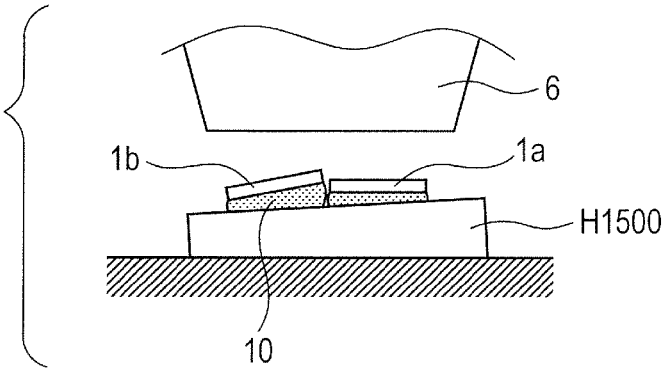
FIG. 10C Prior Art

As illustrated in FIG. 9, the electrical wiring member H1300 having flying leads H1304 includes a base material H1301 of polyimide and electrical wirings H1305 formed on the base material 1301. The electrical wirings H1305 are formed by means of a wiring pattern of copper foil so as to apply electric signals for ink ejection to the energy generating elements H1103 of the substrate H1100. As illustrated in FIG. 7, an aperture section H1303 is formed in the electrical wiring member H1300 so as to take in substrates H1100 and arrange them adjacent to the electrical wiring member H1300. A plurality of flying leads H1304 is formed along the edges of the aperture section H1303. The electrically connecting sections H1104 of the substrates H1100 are arranged so as to be located at positions that correspond to the flying leads H1304 of the electrical wiring member H1300 and electrically connected to the respective flying leads H1304 by gang bonding. As illustrated in FIGS. 6 and 7, the electrical wiring member H1300 is provided with external signal input terminals H1302 and the external signal input terminals H1302 are electrically connected to the respective flying leads H1304 by the electrical wirings H1305 illustrated in FIG. 9.

(1-3) Ink-Supply and Holding Member H1500

The ink-supply and holding member H1500 (see FIG. 9) is formed typically by resin molding. The resin material of the ink-supply and holding member H1500 preferably contains a glass filler material by about 5 to 40% and mixed with the latter in order to improve the shape stiffness of the ink-supply and holding member H1500.

Ink supply ports H1200 are formed in the ink-supply and holding member H1500 at positions located right under the respective ink channels H1102 when the substrates H1100 are mounted on the ink-supply and holding member H1500 so as to operate as ink channels for supplying ink to the substrates H1100. More specifically, the substrates H1100 are rigidly bonded to the ink-supply and holding member H1500 such that the ink channels H1102 of the substrates H1100 are held in communication with the respective ink supply ports H1200 of the ink-supply and holding member H1500. The adhesive agent to be used for bonding the substrates H1100 to the ink-supply and holding member H1500 preferably has a low viscosity and a low setting temperature and is set in a short period of time so as to represent a relatively high rigidity and a high ink-resistivity once it is set. Exemplar adhesive agents that can be used for the present invention include thermosetting adhesive agents containing epoxy resin as main ingredient. When such a thermosetting adhesive agent is employed, the thickness of the adhesive layers is preferably about 50 μm. A part of the rear surface of the electrical wiring member H1300 is rigidly bonded by the adhesive agent to the flat top surface area of the ink-supply and holding member H1500 surrounding the bonded surfaces of the substrates H1100.

The electrically connecting sections connecting the substrates H1100 and the electrical wiring member H1300 are sealed by first sealing agent H1307 and second sealing agent H1308 (see FIGS. 6 and 9) so as to be protected against corrosions by ink and external impacts. The first sealing agent H1307 seals the rear surface sides of the connecting sections of the flying leads H1304 and the electrically connecting sections H1104 and the outer peripheral parts of the substrates H1100, whereas the second sealing agent H1308 seals the front surface sides of the electrically connecting sections H1104.

The non-bonded part of the electrical wiring member H1300 is bent and rigidly secured either by thermal caulking or by means of an adhesive agent to the lateral surface of the ink-supply and holding member H1500 that is substantially perpendicular to the surface thereof to which the substrates H1100 are bonded (see FIG. 7).

Now, embodiments of the present invention will be described below. The embodiments described below relate to the connecting sections of the flying leads H1304 and the electrically connecting sections H1104 of the substrates H1100. In the following description, the two substrates H1100 are referred to as substrate 1*a* and substrate 1*b*. Of the electrically connecting sections 1104 of the substrates 1*a* and 1*b*, those that are connected to the energy generating elements H1103 are referred to as primary terminals 3 while those that are not connected to any energy generating elements H1103 are referred to as auxiliary terminals (dummy terminals) 4*a* and 4*b*. Of the flying leads H1304, those that are connected to the primary terminals 3 are referred to as primary flying leads 2 while those that are connected to the auxiliary terminals (dummy terminals) 4*a* and 4*b* are referred to as auxiliary flying leads (dummy leads) 9*a* and 9*b*.

While two substrates are provided in each of the embodiments that will be described below, any number of substrates can be arranged in a liquid ejection head according to the present invention. When three or more than three substrates are provided, auxiliary terminals and auxiliary leads are arranged at the opposite lateral sides of the substrates that are arranged adjacent to other substrates at the opposite ends of the array of substrates. If such is the case, the arrangement that will be described below for the auxiliary terminals and the auxiliary flying leads at the opposite lateral sides equally applies. The only requirement to be met by the substrates arranged at the opposite ends is that auxiliary terminals and auxiliary flying leads are provided at the side of each of the substrates located close to the adjacent substrate, although auxiliary terminals and auxiliary flying leads may also be provided at the side of each of the substrates located remote from the adjacent substrate.

First Embodiment

Figure 1:
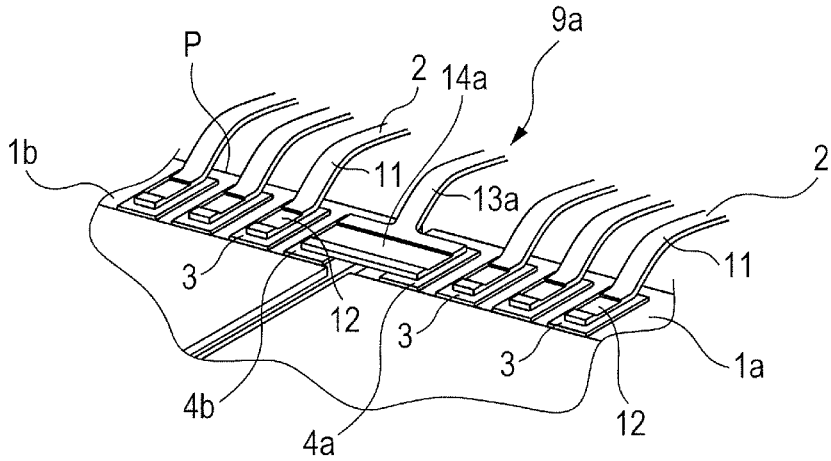
FIG. 1 is a schematic illustration according to a first embodiment of the present invention.

FIG. 1 is a schematic illustration according to a first embodiment of the present invention. Two substrates 1*a* and 1*b* are so arranged as to be located adjacent to each other with a desired gap separating them. The substrate 1*a* has primary terminals 3 and an auxiliary terminal 4*a* disposed adjacent to its primary terminal located closest to the substrate 1*b*. The substrate 1*b* has primary terminals 3 and an auxiliary terminal 4*b* disposed adjacent to its primary terminal located closest to the substrate 1*a*. The auxiliary terminals 4*a* and 4*b* of the substrates 1*a* and 1*b* are disposed adjacent to each other.

A plurality of primary flying leads 2 are arranged on each of the substrates 1*a*, 1*b*, and each of the plurality of primary flying leads 2 includes a lead section 11 extending toward a corresponding primary terminal 3 and a connecting section 12 connected to the primary terminal 3. An auxiliary flying lead 9*a* is arranged on the substrates 1*a* and 1*b* and includes a single lead section 13*a* extending between the auxiliary terminal 4*a* of one of the substrates, or the substrate 1*a*, and the auxiliary terminal 4*b* of the other substrate 1*b* and a connecting section riding on the auxiliary terminals 4*a* and 4*b* of the two substrates 1*a* and 1*b* so as to be connected to the auxiliary terminals 4*a* and 4*b* of the two substrates 1*a* and 1*b* and extending substantially in parallel with the short sides P of the substrates 1*a* and 1*b*.

The lead sections 11 of the primary flying leads 2 and the lead section 13*a* of the auxiliary flying lead 9*a* has the same shape. Differently stated, all the primary flying leads 2 and the auxiliary flying lead 9*a* have the same shape and width except the connecting sections 12, 14*a* and hence they represent the same reaction force when they are formed.

With this embodiment, since the auxiliary flying lead 9*a* rigidly holds the auxiliary terminal 4*a* of the substrate 1*a* and the auxiliary terminal 4*b* of the substrate 1*b*, any relative movement of the auxiliary terminals 4*a* and 4*b* is suppressed so that the substrates 1*a* and 1*b* can be held to the same single plane as a whole with ease.

Second Embodiment

Figure 2:
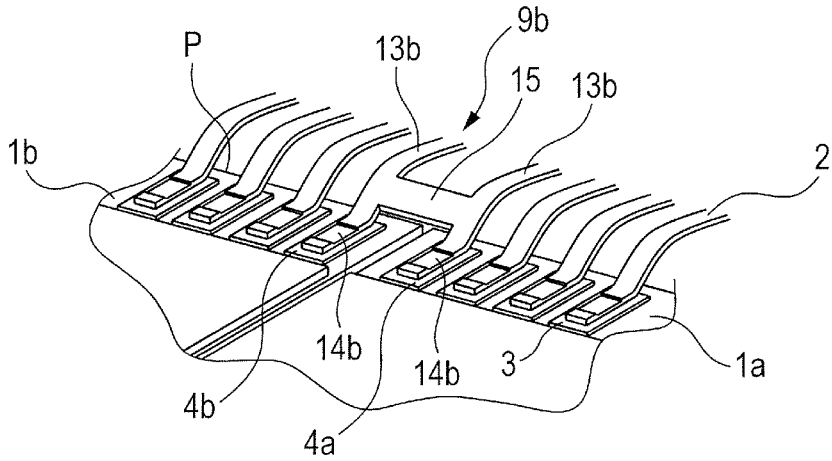
FIG. 2 is a schematic illustration according to a second embodiment of the present invention.

FIG. 2 is a schematic illustration according to a second embodiment of the present invention. While this embodiment also has a single auxiliary flying lead 9*b* connected to the auxiliary terminals 4*a* and 4*b* of the two substrates 1*a* and 1*b* by gang bonding just like the first embodiment, the auxiliary flying lead 9*b* of this embodiment is bifurcated so as to extend separately toward the auxiliary terminals 4*a* and 4*b*. More specifically, the auxiliary flying lead 9*b* of this embodiment has lead sections 13*b* whose number is the same as the number of auxiliary terminals 4*a* and 4*b* (two in the illustrated instance) and the lead sections 13*b* are linked to each other by an arm section 15. The lead sections 13*b* are connected to the respective auxiliary terminals 4*a* and 4*b* by respective connecting sections 14*b*, while the arm section 15 extends substantially in parallel with the short sides P of the substrates 1*a* and 1*b* at a position separated from the connecting sections 14*b* to link the two adjacently located lead sections 13*b*.

Although not-illustrated in FIG. 2, a plurality of auxiliary terminals 4*a* and 4*b* may be provided at least on one of the substrates 1*a* and 1*b*. If such is the case, the only requirement to be met is that at least the lead sections located closest to the oppositely disposed ends of the substrates 1*a* and 1*b* are linked by an arm section, although all the lead sections may be linked by an arm section.

With the first embodiment illustrated in FIG. 1, if the gap separating the auxiliary terminal 4*a* of the substrate 1*a* and the auxiliary terminal 4*b* of the substrate 1*b* is large in the direction running in parallel with the short sides P of the substrates 1*a* and 1*b*, the connecting section 14*a* of the auxiliary flying lead 9*a* inevitably needs to be made long along the short sides P of the substrates. Then, the posture of the connection section 14*a* becomes instable before the gang bonding operation of connecting the auxiliary flying leads 9*b* to the auxiliary terminals 4*a* and 4*b* to consequently damage the reliability of the gang bonding operation. On the other hand, with this embodiment illustrated in FIG. 2, the lead sections of the auxiliary flying lead 9*b* have the same configuration as the lead sections 2 of the primary flying leads 2 and the arm section 15 that corresponds to the connecting section 14*a* in FIG. 1 is located remote from the electrically connecting sections of the substrates. Thus, the front end sections (connecting sections 14*b*) of the auxiliary flying lead 9*b* to be thermally crimped are hardly confined by each other in the thermal crimping operation so that the reliability of the gang bonding operation can be prevented from being damaged. Note, however, that the arm section 15 is desirably located close to the auxiliary terminals 4*a* and 4*b* for the purpose of suppressing any relative movement of the adjacently located substrates 1*a* and 1*b*.

Thus, the lead sections of the auxiliary flying lead 9*b* and the lead sections of the primary flying leads 2 of this embodiment have the same shape so that the reliability of the gang bonding operation can be ensured and the substrates 1*a* and 1*b* can be held to the same single plane as a whole with ease.

Third Embodiment

Figure 3:
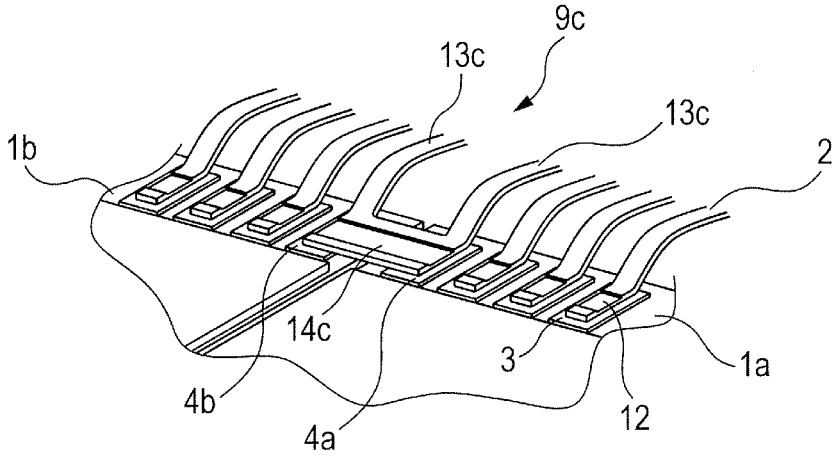
FIG. 3 is a schematic illustration according to a third embodiment of the present invention.

FIG. 3 is a schematic illustration according to a third embodiment of the present invention. The auxiliary flying lead 9*c* of this embodiment has lead sections 13*c* extending toward the respective auxiliary terminals 4*a* and 4*b*, the number of which lead sections 13*c* is the same as the number of auxiliary terminals 4*a* and 4*b* (two in the illustrated instance) and all the lead sections 13*c* are linked to a connecting section 14*c*. The two auxiliary terminals 4*a* and 4*b* are disposed on the respective substrates 1*a* and 1*b*. The connecting section 14*c* that connects the auxiliary terminals 4*a* and 4*b* has a configuration similar to that of the connecting section 14*a* of the first embodiment and corresponds to the arm section 15 of the second embodiment.

As described above for the second embodiment, when the auxiliary terminal 4*a* and the auxiliary terminal 4*b* are separated from each other by a large gap, the reliability of gang bonding can be damaged. When, on the other hand, the lead sections of the auxiliary flying lead 9*b* are linked to each other by an arm section 15 as illustrated in FIG. 2, sufficient force may not be secured to hold the adjacently arranged substrates 1*a* and 1*b* in position. In this embodiment, the lead sections 13*c* are connected to the opposite ends of the connecting section 14*c*. In other words, the connecting section 14*c* is held by two lead sections 13*c* so that the postures of the parts of the auxiliary terminals and the auxiliary flying lead that are to be thermally crimped can hardly become instable before the gang bonding operation to be executed on them. Additionally, all the primary flying leads 2 and the auxiliary flying lead 9*a* have the same shape and width except the connecting sections 12, 14*c* and hence they represent the same reaction force when they are formed so that the connecting sections 14*c* are held by the two lead sections 13*c* with uniform force.

Since the connecting section 14*c* is held by the two lead sections 13*c* located at the opposite sides, the reliability of the gang bonding operation can be ensured and the substrates 1*a* and 1*b* can be held to the same single plane as a whole with ease.

Fourth Embodiment

Figure 4:
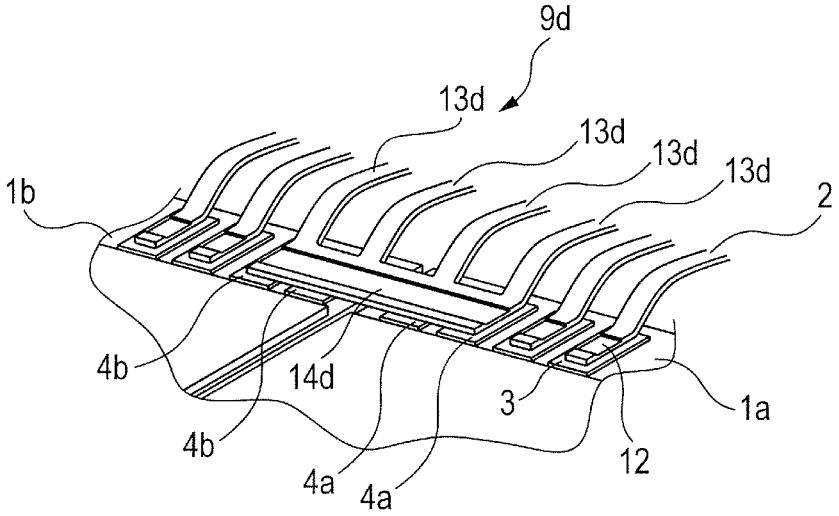
FIG. 4 is a schematic illustration according to a fourth embodiment of the present invention.

FIG. 4 is a schematic illustration according to a fourth embodiment of the present invention. In this embodiment, at least either of the auxiliary terminals 4*a*, 4*b* of the substrates 1*a* and 1*b* is actually provided as a plurality of auxiliary terminals 4*a* and 4*a*, or 4*b* and 4*b* that are arranged side by side. The auxiliary flying lead 9*d* of this embodiment has lead sections 13*d* extending toward the respective auxiliary terminals 4*a*, 4*a*, 4*b* and 4*b*, the number of which lead sections 13*d* is same as the number of auxiliary terminals 4*a*, 4*a*, 4*b* and 4*b* (four in the illustrated instance) and all the lead sections 13*d* are linked to a connecting section 14*d* that extends transversally so as to ride on all the auxiliary terminals 4*a*, 4*a*, 4*b* and 4*b* of the two substrates 1*a* and 1*b* and is connected to all the auxiliary terminals 4*a*, 4*a*, 4*b* and 4*b*.

Thus, both of the substrates 1*a* and 1*b* of this embodiment are provided with two auxiliary terminals 4*a*, 4*a* and 4*b*, 4*b* and the four auxiliary terminals 4*a*, 4*a*, 4*b* and 4*b* are linked to the respective lead sections 13*d*. However, each of the substrates 1*a* and 1*b* may be provided with any number of auxiliary terminals. The only requirement to be met for this embodiment is that at either of the substrates is provided with two or more than two auxiliary terminals. Since a larger number of auxiliary terminals of this embodiment are held by a single connecting section 14*d* than any other embodiments, the force for holding the adjacently arranged substrates 1*a* and 1*b* in position can easily be acquired. Thus, if the substrates 1*a* and 1*b* have a large length and/or a large width or the adjacently located auxiliary terminals 4*a*, 4*a*, 4*b* and 4*b* are arranged side by side over a long distance, this embodiment can provide sufficient force for satisfactorily holding them in position.

Thus, not only the outermost auxiliary terminals 4*a*, 4*b* but also the auxiliary terminals located at the inside relative to the outermost auxiliary terminals 4*a* and 4*b* of this embodiment are linked to each other by a single connecting section 14*d* and hence the force for holding the substrates 1*a* and 1*b* in position of this embodiment is raised further to make it easier to hold the substrates 1*a* and 1*b* in position.

(Method of Manufacturing Liquid Ejection Head)

Finally, a method of manufacturing a liquid ejection head described above that includes steps of linking substrates and an electrical wiring member by means of a gang bonding system and subsequently bonding the substrates and the electrical wiring member to an ink-supply and holding member will be described below. While the embodiment that will be described below uses two substrates, the following description equally applies to a liquid ejection head having three or more than three substrates.

Figure 5A:
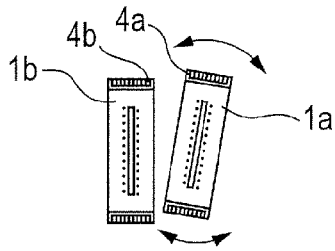
FIGS. 5A, 5B, 5C, 5D and 5E are a schematic illustration of the steps of bonding substrates, an electrical wiring member and an ink-supply and holding member to each other.

FIGS. 5A through 5E are a schematic illustration of the steps. Firstly, as illustrated in FIG. 5A, two substrates 1*a* and 1*b* are arranged so as to be located adjacent to each other, separated from each other by a predetermined gap and disposed in parallel with each other. More specifically, the two substrates 1*a* and 1*b* are arranged such that the auxiliary terminals 4*a* and 4*b* of the adjacently located two substrates 1*a* and 1*b* are disposed side by side.

Figure 5B:
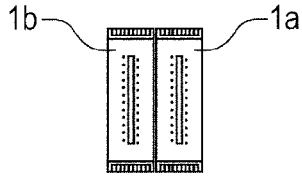

Then, as illustrated in FIG. 5B, the two substrates 1*a*, 1*b* are placed on a gang bonding jig (not illustrated). At this time, a technique that utilizes image processing, an abutment technique or some other appropriate technique may be selectively employed for aligning the substrates 1*a*, 1*b* according to the required level of performance of the liquid ejection head.

Figure 5C:
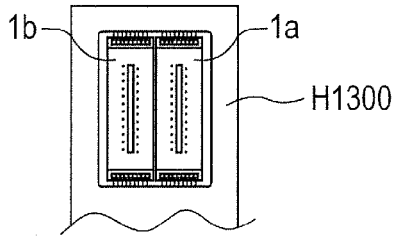

Subsequently, as illustrated in FIG. 5C, an electrical wiring member H1300 is placed on the gang bonding jig. At this time, the primary terminals and the auxiliary terminals of the substrates 1*a* and 1*b* and the primary flying leads and the one or more than one auxiliary flying leads of the electrical wiring member H1300 are placed so as to represent a predetermined positional relationship.

Figure 5D:
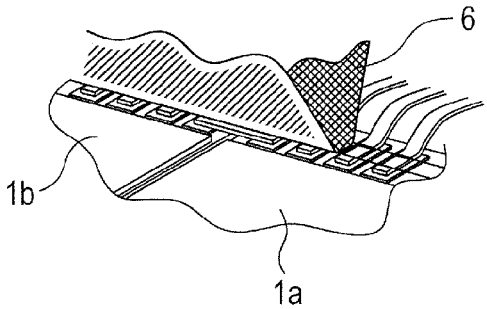

Thereafter, as illustrated in FIG. 5D, a thermal crimping operation is executed by means of a gang bonding tool 6 in a condition where the substrates 1*a*, 1*b* and the electrical wiring member H1300 are placed at predetermined respective positions. While such a gang bonding operation can be executed collectively on all the substrates, the operation may be divided and executed for a number of times depending on the size of the substrates and the number of substrates that are arranged.

Figure 5E:
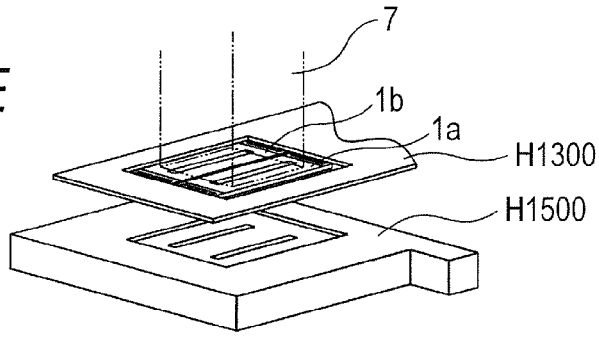

Then, finally as illustrated in FIG. 5E, the substrates 1*a*, 1*b* and the electrical wiring member H1300 that are thermally crimped are brought up from the gang bonding jib by means of an alignment finger 7 and placed in position on an ink-supply and holding member H1500 so as to make them represent a predetermined positional relationship. A thermosetting adhesive agent is applied to the ink-supply and holding member H1500 in advance. Then, the substrates 1*a* and 1*b* and the electrical wiring member H1300 are placed on the adhesive agent and preliminarily secured. Subsequently, the thermosetting adhesive agent is set by thermal curing to rigidly hold the substrates 1*a* and 1*b* and the electrical wiring member H1300 onto the ink-supply and holding member H1500.

With the above-described method, the substrates and the electrical wiring member can be electrically connected to each other by gang bonding that is advantageous from the viewpoint of processing tact and processing conditions. Since an alignment finger can receive the substrates, while maintaining the condition where the substrates are held to the electrical wiring member and aligned (posture), and deliver them to an ink-supply and holding member, it can improve the reliability of the subsequent bonding process.

While the present invention has been described with reference to exemplary embodiments, it is to be understood that the invention is not limited to the disclosed exemplary embodiments. The scope of the following claims is to be accorded the broadest interpretation so as to encompass all such modification and equivalent structures and functions.

This application claims the benefit of Japanese Patent Application No. 2012-163589, filed Jul. 24, 2012, which is hereby incorporated by reference herein in its entirety.

What is claimed is:

1. A liquid ejection head comprising:

a first substrate and a second substrate disposed side by side, each having energy generating elements and primary terminals electrically connected to the respective energy generating elements; and an electrical wiring member having primary flying leads electrically connected to the respective primary terminals by a gang bonding system, the electrical wiring member being arranged adjacent to the first and second substrates, wherein each of the first and second substrates has an auxiliary terminal located adjacent to the respective primary terminals, the auxiliary terminals of the substrates being disposed adjacent to each other, the electrical wiring member having an auxiliary flying lead connected to or a pair of auxiliary flying leads respectively connected to the auxiliary terminals of the first and second substrates by a gang bonding system.

2. The liquid ejection head according to claim 1, wherein the auxiliary flying lead has a connecting section that extends so as to ride on the auxiliary terminals of the first and second substrates and is connected to the auxiliary terminals of the first and second substrates.

3. The liquid ejection head according to claim 2, wherein the auxiliary flying lead has a single lead section that extends toward a space between the auxiliary terminal of one of the first and second substrates and the auxiliary terminal of the other of the first and second substrates and is linked to the connecting section.

4. The liquid ejection head according to claim 2, wherein the auxiliary flying lead has lead sections, the number of which is the same as the number of the auxiliary terminals, and which extend toward the respective auxiliary terminals, and all the lead sections are linked to the connecting section.

5. The liquid ejection head according to claim 1, wherein the auxiliary terminal of at least either of the first and second substrates is realized as a plurality of auxiliary terminals that are arranged side by side and the auxiliary flying lead has a connecting section that extends so as to ride on all the auxiliary terminals of the first and second substrates and is connected to all the auxiliary terminals.

6. The liquid ejection head according to claim 1, wherein the auxiliary flying lead has lead sections, the number of which is the same as the number of auxiliary terminals, and which extend toward the respective auxiliary terminals, connecting sections that are linked to the respective lead sections and individually connected to the respective auxiliary terminals, and an arm section linking the lead sections.

7. The liquid ejection head according to claim 1, wherein each of the primary flying leads has a lead section that extends toward the corresponding primary terminal and a connecting section that is connected to the corresponding primary terminal and the lead section of each of the primary flying leads has a shape same as the lead section of the auxiliary flying lead.

8. The liquid ejection head according to claim 1, wherein the auxiliary flying lead is a dummy lead that is not connected to any energy generating elements.

9. A method of manufacturing a liquid ejection head comprising:

providing a first substrate and a second substrate, each having energy generating elements, primary terminals electrically connected to the respective energy generating elements and one or more than one auxiliary terminals disposed adjacent to the respective primary terminals;

arranging the first and second substrates so as to be located side by side such that the auxiliary terminal of one of the first and second substrates is disposed adjacent to that of the other of the first and second substrates; and arranging an electrical wiring member having at least two primary flying leads and an auxiliary flying lead adjacent to the first and second substrates and electrically connecting the primary terminals to the respective primary flying leads and also the auxiliary terminals of the first and second substrates to the auxiliary flying lead by a gang bonding system.

10. The method of manufacturing a liquid ejection head according to claim 9, wherein the auxiliary flying lead has a connecting section that extends so as to ride on the auxiliary terminals of the first and second substrates and is connected to the auxiliary terminals of the first and second substrates.

* * * * *